US005485727A

United States Patent [19]

Godfrey

[11] Patent Number: 5,485,727

[45] Date of Patent: Jan. 23, 1996

[54] FASTENER INSTALLATION TOOL

[75] Inventor: Bruce T. Godfrey, Royal Oak, Mich.

[73] Assignee: GBP Corporation, Warren, Mich.

[21] Appl. No.: 338,046

[22] Filed: Nov. 14, 1994

[51] Int. Cl.[6] ..... F15B 7/10; B26B 13/00

[52] U.S. Cl. ..... 60/572; 60/592; 29/243.523; 29/243.525

[58] Field of Search ..... 60/547.1, 572, 60/573, 592, 593; 29/243.523, 243.524, 243.525

[56] References Cited

U.S. PATENT DOCUMENTS

| | | | |
|---|---|---|---|
| 3,039,270 | 6/1962 | Simmons | 60/54.5 |
| 3,254,522 | 6/1966 | Elliott et al. | 29/243.525 |
| 3,475,945 | 11/1969 | Chirco | 72/391 |
| 3,713,321 | 1/1973 | LaPointe | 72/391 |
| 4,587,829 | 5/1986 | Sukharevsky | 29/243.522 |
| 4,597,263 | 7/1986 | Corbett | 60/534 |
| 4,796,455 | 1/1989 | Rosier | 72/391 |
| 4,813,261 | 3/1989 | Rosier | 72/391 |
| 4,878,372 | 11/1989 | Port et al. | 72/391 |
| 4,879,875 | 11/1989 | Davert et al. | 60/592 X |
| 5,072,501 | 12/1991 | Vincenzo | 29/243.523 X |
| 5,208,959 | 5/1993 | Rosier et al. | 29/252 |
| 5,371,933 | 12/1994 | Godfrey | 29/243.529 |

*Primary Examiner*—Edward K. Look
*Assistant Examiner*—Hoang Nguyen
*Attorney, Agent, or Firm*—Young, MacFarlane & Wood

[57] ABSTRACT

A fastener installation tool of the push/pull type including an air piston driving a hydraulic piston and further including a head piston driven by the hydraulic piston and coacting with the hydraulic piston to form a closed loop hydraulic circuit. The hydraulic piston is a compound piston including a primary piston and a secondary piston mounted in a blind bore in the upper end of the primary piston. When hydraulic pressures in the closed loop hydraulic circuit exceed a predetermined limit, the secondary piston moves downwardly, against the bias of an internal spring, relative to the primary piston to reduce the overall volume of the compound piston and thereby reduce the pressure in the closed loop hydraulic circuit.

8 Claims, 3 Drawing Sheets

FASTENER INSTALLATION TOOL

BACKGROUND OF THE INVENTION

This invention relates generally to pneumatic-hydraulically operated tools and more particularly to such tools which are designed for use in the installation of pull type fasteners.

In installation tools for pull type fasteners a source of compressed air is normally applied to opposite sides of a pneumatic piston and the pneumatic piston is connected to a hydraulic piston reciprocally disposed within a bore forming a part of a closed loop hydraulic circuit so that the hydraulic piston reciprocates in unison with the pneumatic piston. The hydraulic piston in turn operates to transmit hydraulic pressure to a slave or driving piston reciprocally mounted in a bore in the head of the tool and also forming a part of the closed loop hydraulic circuit. The piston in the head of the tool has apparatus associated therewith for setting a fastener in known manner in response to reciprocal movement of the head piston. The closed loop hydraulic circuit experiences extremely high pressures which can, if not controlled, result in bursting with resultant tool damage and possible personal injury. For this reason it is common practice to incorporate some kind of a pressure relief valve system in the tool to ensure that the pressure in the closed loop hydraulic circuit does not exceed a predetermined safe upper limit. Whereas these pressure relief valves have been effective in precluding bursting of the tool and consequent tool damage and personal injury, they add considerably to the complexity and cost of the tool as well as to the maintenance requirements of the tool.

SUMMARY OF THE INVENTION

This invention is directed to the provision of a fastener installation tool having improved means for controlling the pressure in the tool.

More specifically this invention is directed to the provision of a fastener installation tool having a pressure release system of simple and inexpensive design.

The fastener installation tool of the invention includes a housing assembly defining a head including a head bore, an air chamber, and a neck interconnecting the head and the air chamber and encompassing a neck bore; a head piston mounted in the head bore and adapted to be connected to a pulling head; a neck piston mounted in the neck bore; an air piston mounted in the air chamber; a piston rod connecting the air piston to the neck piston; means for delivering pressurized air to the air chamber to selectively move the air piston in the air chamber and thereby move the neck piston in the neck chamber; first passage means interconnecting a location in the neck bore on one side of the neck piston and a location in the head bore on one side of the head piston; second passage means interconnecting a location in the neck bore on the other side of the neck piston and a location in the head bore on the other side of the head piston and coacting with the first passage means in the neck and head bores to define a closed loop hydraulic circuit; and hydraulic fluid filling the hydraulic circuit.

According to the invention, one of the neck and head pistons includes means operative to vary the volume of the one piston in response to variations in the hydraulic pressure acting against the one piston. This arrangement provides a simple and effective means for controlling the pressure in the closed loop hydraulic circuit.

According to a further feature of the invention, the piston whose volume is varied in response to variations in the pressure in the hydraulic circuit is the neck piston. This arrangement allows the sanctity of the head piston to be maintained while yet providing the necessary pressure relief means in the closed loop hydraulic circuit.

According to a further feature of the invention, the means operative to vary the volume of the one piston includes a secondary piston mounted in the one piston, exposed to the hydraulic pressure acting against the one piston, and operative in response to hydraulic pressure in excess of a predetermined limit to move to a position in which the volume of the one piston is diminished. This compound piston arrangement provides a simple and effective means of varying the volume of the one piston in response to excessive hydraulic pressure.

According to a further feature of the invention, the neck is generally vertically oriented with the head positioned on top of the neck and the air chamber position below the neck; the neck bore expends generally vertically; the neck piston divides the neck bore into an upper neck bore portion above the neck piston and a lower neck bore portion below the neck piston; the head piston divides the head bore into a rearward head bore portion behind the head piston and a forward head bore portion ahead of the head piston; the first passage means interconnects the upper neck bore portion and the rearward head bore portion; and the secondary piston is mounted in the upper end of the neck piston and is exposed to the hydraulic pressure in the upper neck bore portion. This specific arrangement provides a ready and effective means of detecting and counteracting any excessive build-up in the maximum pressure experienced in the closed loop hydraulic circuit.

In the disclosed embodiment of the invention, the secondary piston is positioned in a blind bore opening in the upper end of the neck piston, and a spring is positioned in the blind bore beneath the secondary piston and biases the secondary piston upwardly to a normal position in which the upper face of the secondary piston is proximate the upper end of the neck piston.

DETAILED DESCRIPTION OF THE PREFERRED EMBODIMENT

Figure 1:
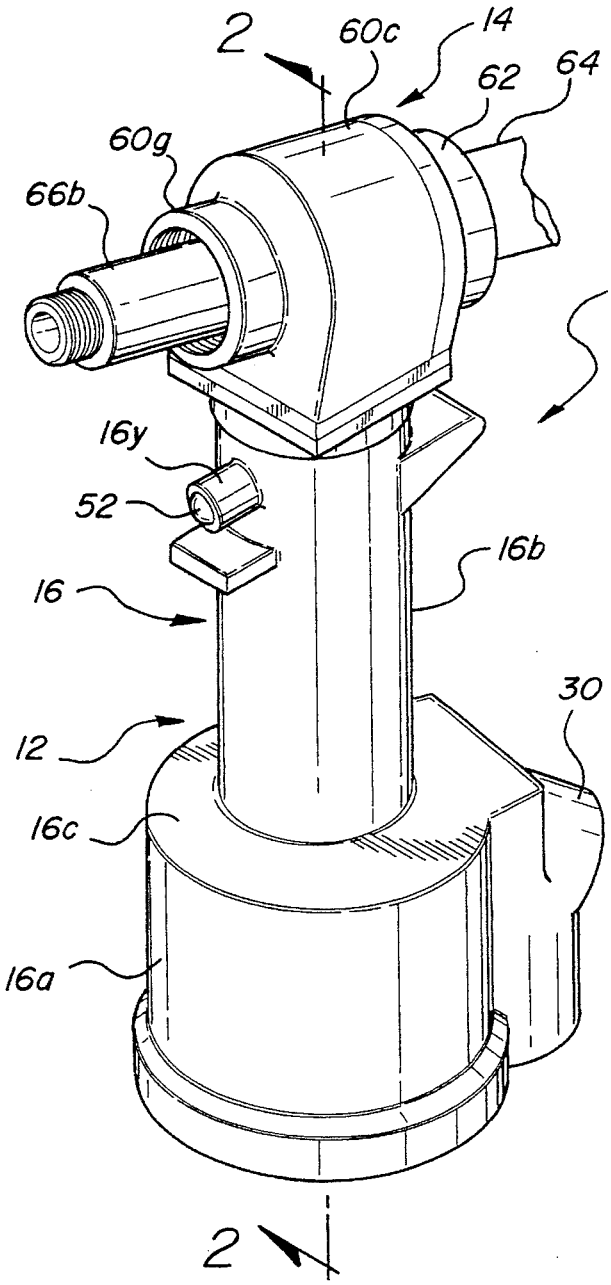
FIG. 1 is a perspective view of the invention fastener installation tool.
Figure 3:
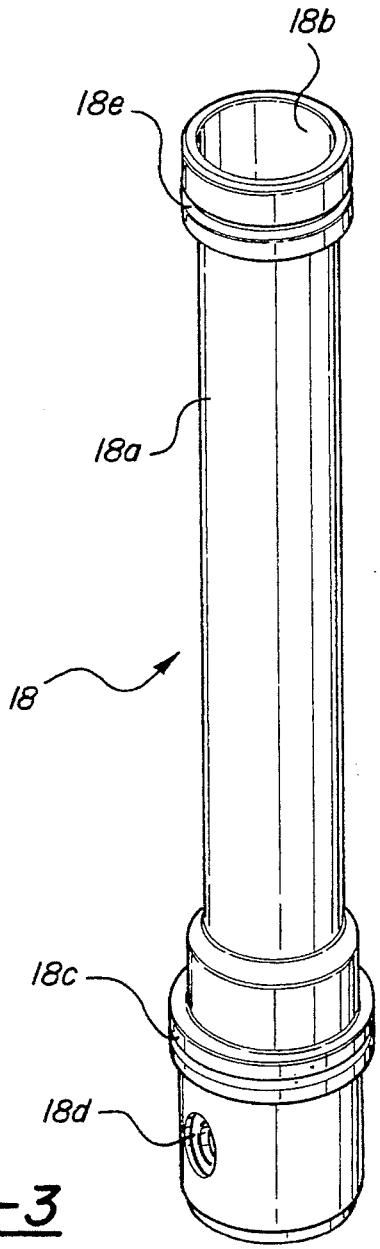
FIGS. 3, 4 and 5 are perspective detail views of individual components of the invention fastener installation tool.
Figure 2:
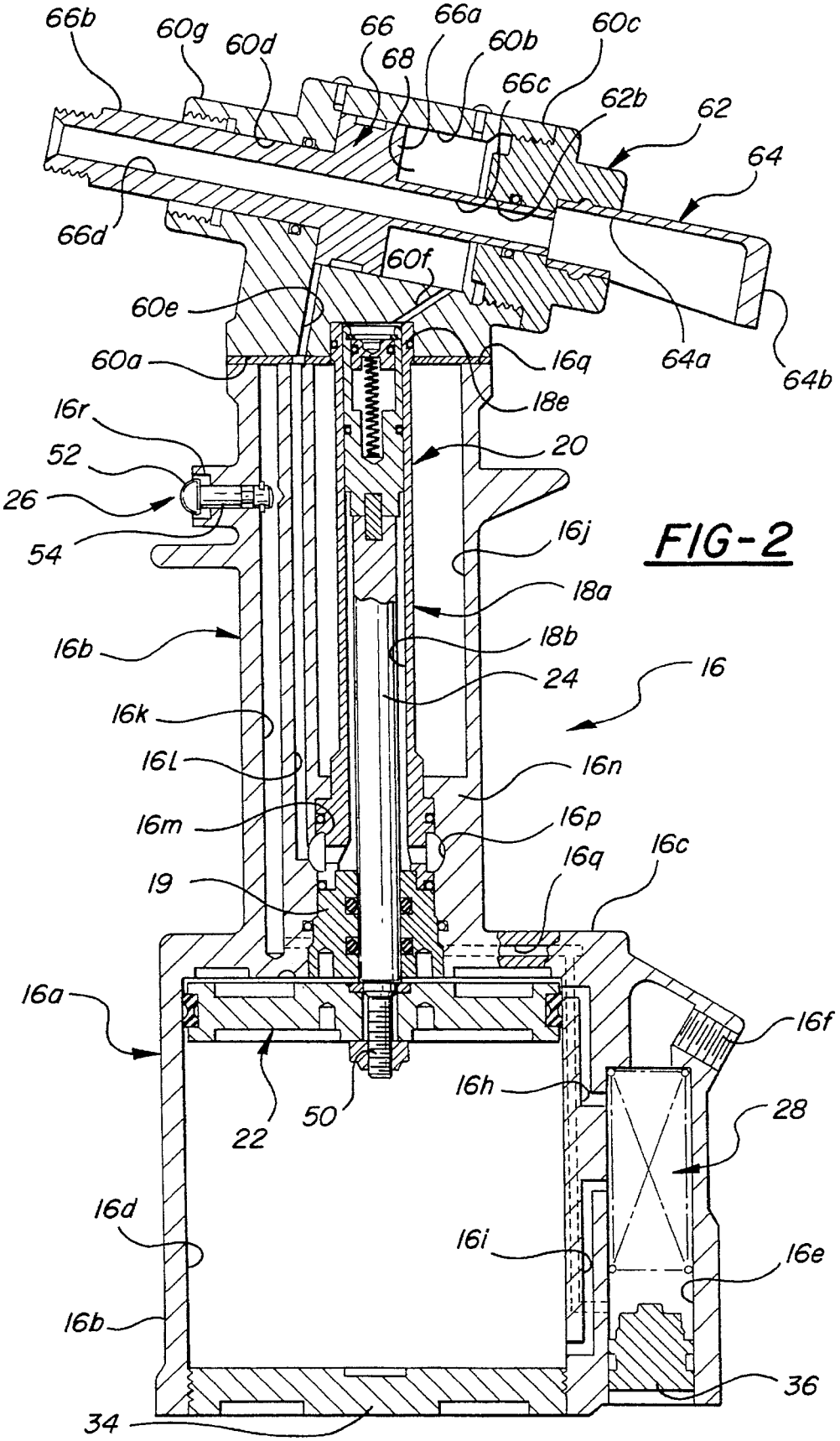
FIG. 2 is a cross sectional view taken on line 2—2 of FIG. 1.
Figure 4:
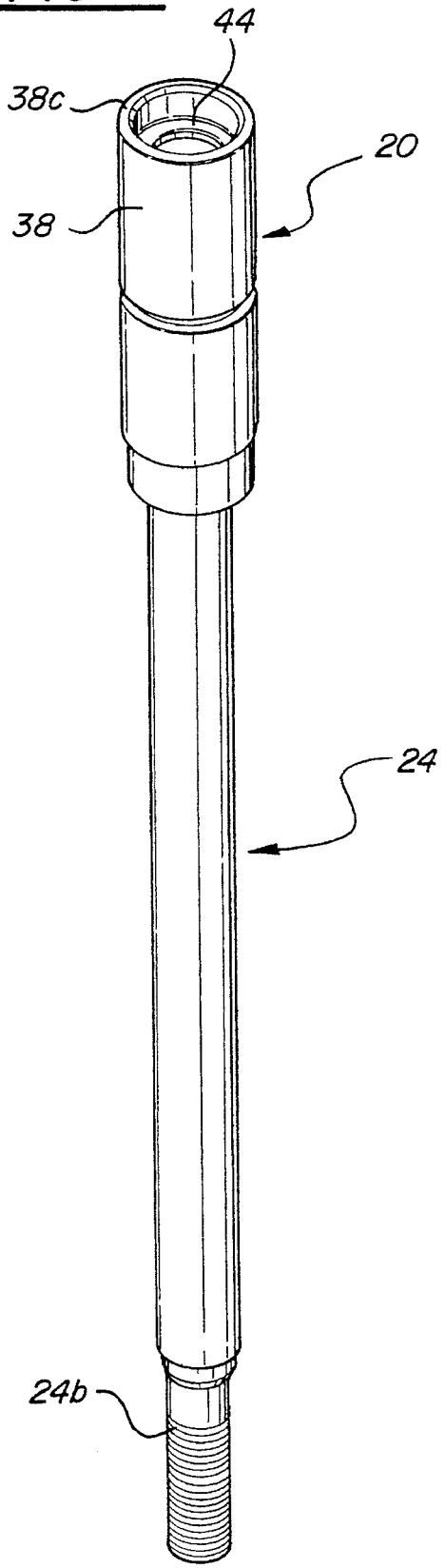
Figure 5:
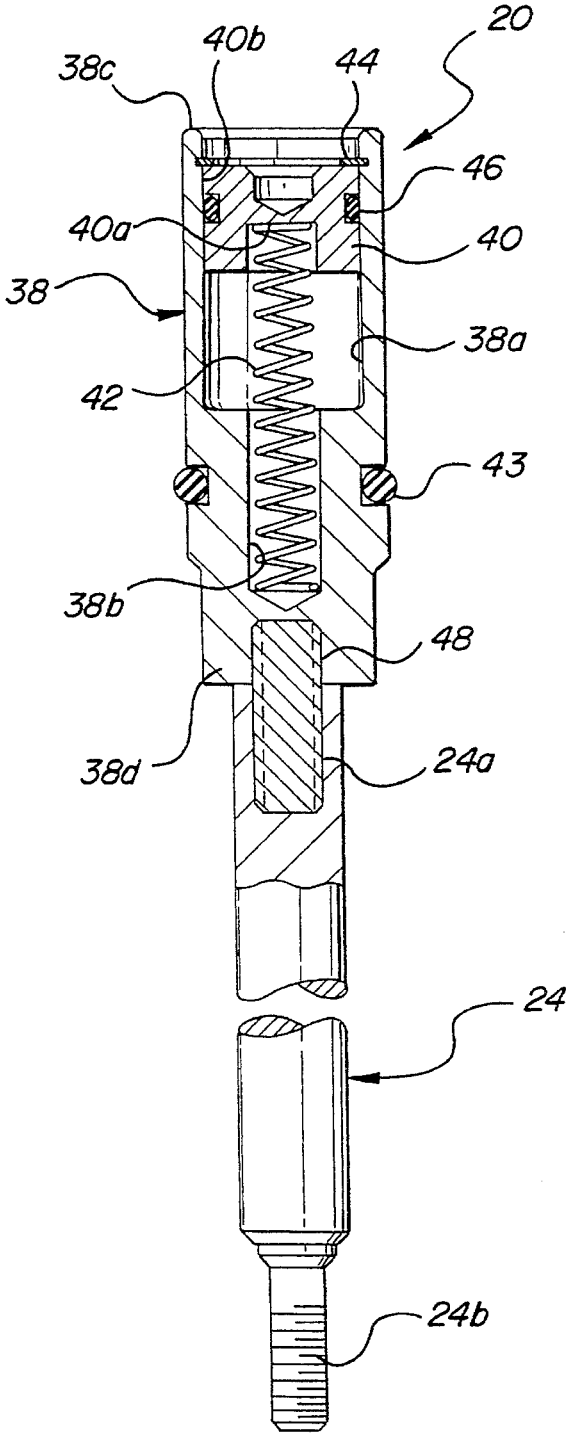

The fastener installation tool 10 seen in perspective view in FIG. 1 and in cross sectional view in FIG. 2, broadly considered, includes a handle assembly 12 and a head assembly 14.

Handle assembly 12 includes a housing 16, a cylinder 18, a packing plug 19, a hydraulic piston assembly 20, an air piston 22, a piston rod 24, a push button assembly 26, a spool valve 28, an air chamber plug 34, and a valve chamber plug 36.

Housing 16 is formed of a suitable cast non-ferrous material and includes a base portion 16*a* and a neck portion 16*b* upstanding from the upper wall 16*c* of the base portion.

Base portion 16*a* defines a cylindrical air chamber 16*d*, a valve chamber 16*e*, an air inlet 16*f*, and air passages 16*g*, 16*h* and 16*i*.

Neck portion 16*b* defines an upwardly opening central chamber 16*j*, an air passage 16*k* communicating at its lower end with air passage 16*g* in the base portion, and a hydraulic fluid passage 16*l*.

Cylinder 18 includes a main body tubular portion 18*a* defining a central bore 18*b*, a base portion 18*c*, and apertures 18*d* at diametrically opposed locations in the base portion. Cylinder base portion 18*c* is mounted in a bore 16*m* in a solid lower portion 16*n* of the housing neck portion generally centrally of the housing neck portion with apertures 18*d* communicating with a circumferential groove 16*p* in bore 16*m* which in turn communicates with the lower end of hydraulic passage 161 so as to establish communication between the bore 18*a* of cylinder 18 and passage 161. The upper end 18*e* of the cylinder extends to a location slightly above the upper end 16*q* of the neck portion of the housing.

Packing plug 19 is positioned in the lower end of bore 16*m* beneath cylinder base portion 18*c*.

Hydraulic piston assembly 20 includes a primary piston 38, a secondary piston 40, and a spring 42. Primary piston 38 is slidably positioned in cylinder bore 18*a* utilizing an O-ring 43 and includes a blind bore 38*a* opening at the upper end of the piston slidably receiving secondary piston 40. Spring 42 is a coil spring received at its lower end in a blind counterbore 38*b* in the piston 38 and extending upwardly for receipt at its upper end in a blind downwardly opening bore 40*a* in secondary piston 40. Spring 42 acts to normally urge secondary piston 40 upwardly within blind bore 38*a* to a position in which the upper face 40*b* of the secondary piston is positioned proximate the upper end 38*c* of the primary piston by a retaining ring 44 mounted in an internal groove in blind bore 38*a* proximate the upper end of the primary piston 38. An O-ring 46 positioned in a groove in the secondary piston provides a hydraulic fluid seal as between the primary piston and the secondary piston.

Air piston 22 has a cylindrical configuration and fits slidably in air chamber 16*d* with appropriate sealing.

Piston rod 24 includes an upper end 24*a* which is secured to the lower end 38*d* of piston 38 by a threaded pin 48 and extends downwardly from the piston 38 within cylinder bore 18*b* and through packing plug 19 to a threaded lower end 24*b* which passes downwardly and centrally through air piston 22 for threaded coaction with a nut 50 whereby to fixedly secure the hydraulic piston 38 to the air piston 22 so that the pistons move in unison.

Push button assembly 26 includes a push button 52 positioned in a boss 16*r* in the housing neck portion. Push button 52 is arranged such that when the push button is pushed in, air passage 16*k* is vented and when the push button is released and allowed to move outwardly, air passage 16*k* is blocked.

Spool valve 28 (shown schematically) is positioned in valve chamber 16*e* in communication with air inlet 16*f* and is operative in known manner to selectively deliver pressurized air from air inlet 16*f* to either air passage 16*h* or air passage 16*i*.

Air chamber plug 34 is threadably received in the lower end of air chamber 16*d* so as to close the air chamber and valve chamber plug 36 is received in the lower end of valve chamber 16*e* so as to close the valve chamber.

Head assembly 14 includes a housing 60, a head plug 62, a deflector chute 64, and a head piston 66.

Housing 60 is formed of a suitable cast nonferrous material and is fixedly secured at its lower face 60*a* to the upper end 16*q* of the handle assembly housing utilizing suitable fastener means. Housing 60 defines a head bore 60*b* in the main body 60*c* of the housing extending generally transversely to but slightly upwardly angled with respect to the central axis of piston rod 24, a counterbore 60*d* coaxial with bore 60*d* and opening in the forward end portion 60*g* of the housing, a passage 60*e* extending upwardly from the lower face 60*a* of the housing and opening in the forward end of bore 60*b*, and a passage 60*f* opening at its lower end in an inset 60*f* in the lower face 60*a* of the head housing and opening at its upper end in a rearward portion of bore 60*b*. With head housing 60 secured to the upper end of the handle assembly, the upper end 18*e* of cylinder 18 is positioned in inset 60*f*, the lower end of passage 60*e* aligns with the upper end of passage 161, and the lower end of passage 60*f* opens into the upper end of cylinder bore 18*b*.

Head plug 62 is positioned in the open rear end of bore 60*b* and sealingly closes the bore to define a hydraulic fluid pressure chamber 68.

Deflector chute 64 is positioned at its forward end 64*a* in a counterbore 62*a* of the head plug 62 and includes a rearward deflector portion 64*b* opening downwardly.

Piston 66 includes a main body piston portion 66*a* slidably and sealingly mounted in bore 60*b*, a forwardly projecting piston rod portion 66*b* projecting forwardly through housing counterbore 60*d*, and a tail portion 66*c* projecting rearwardly from main body piston portion 66*a* and slidably received at its rear end in a central bore 62*b* of head plug 62. Piston 66 is tubular and defines a central through bore 66*d* communicating at its rear end with deflector chute 64.

Following the assembly of the fastener installation tools, hydraulic fluid is introduced into cylinder bore 18*b*, head housing passage 60*f*, chamber 68, head housing passage 60*e*, neck passage 161, groove 16*p*, and apertures 18*d* to form a closed loop hydraulic system including pistons 66 and 38.

In the use of the invention fastener installation tool, piston 66 is caused to move in a reciprocating or push/pull fashion within chamber 68 so as to function in known manner to set conventional pull type fasteners including a separable pin tail portion engagable by a jaw assembly attached to the installation tool. Specifically, a jaw assembly portion of a nose assembly (not shown) is secured to piston rod portion 66*b* and a swaging anvil portion of the nose assembly is secured to the forward end portion 60*g* of the head housing so that the jaw assembly and swaging anvil may coact in known manner to set the conventional pull type fasteners and generate a broken off pin tail which is ejected in known manner along the central bore 66*d* of the piston 66 and into the deflector chute 64 for downward discharge by deflector portion 64*b*.

The movement of the piston 66 in its push/pull fashion is controlled by push button 52. Specifically, with air cylinder 22 and hydraulic piston 38 in the raised positions of FIG. 2 and head piston 66 in the forward position of FIG. 2, and with a source of pressurized air connected to air inlet 16*f*, depression of push button 12 has the effect of venting passageway 16*k* which in turn, via passage 16*g*, has the effect of actuating the spool valve 28 in a sense to deliver air through passage 16*h* to the top side of air piston 22 to drive piston 22 downwardly. As air piston 22 moves downwardly hydraulic piston 38 is moved downwardly in unison to drive hydraulic fluid, via apertures 18*c* and passages 16*h* and 60*e*, into the forward end of head bore 60*b* and drive piston 66 rearwardly to achieve the pull portion of the fastener setting movement. Push button 32 is thereafter released and returns to its closed position where passage 16*k* is blocked. This has the sense to deliver pressurized air through passage 16*i* to the bottom side of air piston 22 to drive piston 22 upwardly. As air piston 22 moves upwardly hydraulic piston 38 is moved upwardly in unison to drive hydraulic fluid, via passage 60*f*, into the rear of the rear of chamber 68 and drive piston 66 forwardly to achieve the push portion of the fastener setting movement.

In accordance with the invention, compound cylinder 38/40 acts at all times during the operation of the tool to ensure that the pressure in the closed loop hydraulic circuit operating within the tool does not exceed a predetermined upper limit, whereby to eliminate the possibility of tool damage or personal injury resulting from abnormally high pressures. Hydraulic pressure in excess of a predetermined limit operates to vary the volume of the compound piston 38/40 and, specifically, pressure in excess of the predetermined limit acts downwardly on secondary piston 40 and moves that piston downwardly against the bias of spring 42 when excess pressure is sensed by the exposed upper face of the secondary piston. Movement of the secondary piston downwardly within the blind bore 38*a* of the primary piston has the effect of reducing the overall volume of the compound piston which in turn has the effect of lowering the hydraulic pressure in the closed loop hydraulic circuit.

The invention will be seen to provide a ready and effective means of limiting the internal pressure generated in the hydraulic circuit and, specifically, will be seen to provide a pressure relief function utilizing the existing hydraulic circuitry rather than requiring the addition of a specific pressure relief system with consequent cost, complexity and maintenance requirements.

Whereas a preferred embodiment of the invention has been illustrated and described in detail it will be apparent that various changes may be made in the disclosed embodiment without departing from the scope or spirit of the invention.

I claim:

1. A fastener installation tool including a housing assembly defining a head including a head bore, an air chamber, and a neck interconnecting the head and the air chamber and defining a neck bore; a head piston mounted in the head bore and adapted to be connected to a pulling head; a neck piston slidably mounted in the neck bore; an air piston mounted in the air chamber; a piston rod connecting the air piston to the neck piston; means for delivering pressurized air to the air chamber to selectively move the air piston in the air chamber and thereby move the neck piston in the neck chamber; first passage means interconnecting a location in the neck bore on one side of the neck piston and a location in the head bore on one side of the head piston; second passage means interconnecting a location in the neck bore on the other side of the neck piston and a location in the head bore on the other side of the head piston and coacting with the first passage means and the neck and head bores to define a closed loop hydraulic circuit; and hydraulic fluid filling the hydraulic circuit; characterized in that:

the neck piston is fixedly secured to one end of the piston rod; and one of said neck and head pistons includes means operative to vary the volume of said one piston in response to variations in the hydraulic pressure acting against said one piston.

2. A fastener installation tool according to claim 1 wherein:

said one piston is the neck piston.

3. A fastener installation tool according to claim 1 wherein:

the means operative to vary the volume of said one piston includes a secondary piston mounted in said one piston, exposed to the hydraulic pressure acting against said one piston, and operative in response to hydraulic pressure in excess of a predetermined limit to move to a position in which the volume of said one piston is diminished.

4. A fastener installation tool according to claim 3 wherein:

said one piston is said neck piston;

the neck is generally vertically oriented with the head positioned on top of the neck and the air chamber positioned below the neck;

the neck bore extends generally vertically;

the neck piston divides the neck bore into an upper neck bore portion above the neck piston and a lower neck bore portion below the neck piston;

the head piston divides the head bore into a rearward head bore portion behind the head piston and a forward head bore portion ahead of the head piston;

the first passage means interconnects the upper neck bore portion and the rearward head bore portion; and the secondary piston is mounted in the upper end of said neck piston and is exposed to the hydraulic pressure in said upper neck bore portion.

5. A fastener installation tool including a housing assembly defining a head including a head bore, an air chamber, and a neck interconnecting the head and the air chamber and defining a neck bore; a head piston mounted in the head bore and adapted to be connected to a pulling head; a neck piston mounted in the neck bore; an air piston mounted in the air chamber; a piston rod connecting the air piston to the neck piston; means for delivering pressurized air to the air chamber to selectively move the air piston in the air chamber and thereby move the neck piston in the neck chamber; first passage means interconnecting a location in the neck bore on one side of the neck piston and a location in the head bore on one side of the head piston; second passage means interconnecting a location in the neck bore on the other side of the neck piston and a location in the head bore on the other side of the head piston and coacting with the first passage means and the neck and head bores to define a closed loop hydraulic circuit; and hydraulic fluid filling the hydraulic circuit; characterized in that:

said neck piston includes a secondary piston mounted in said neck piston, exposed to the hydraulic pressure acting against said neck piston, and operative in response to hydraulic pressure in excess of a predetermined limit to move to a position in which the volume of said neck piston is diminished;

the neck is generally vertically oriented with the head positioned on top of the neck and the air chamber positioned below the neck;

the neck bore extends generally vertically;

the neck piston divides the neck bore into an upper neck bore portion above the neck piston and a lower neck bore portion below the neck piston;

the head piston divides the head bore into a rearward head bore portion behind the head piston and a forward head bore portion ahead of the head piston;

the first passage means interconnects the upper neck bore portion and the rearward head bore portion; and the secondary piston is mounted in the upper end of said neck piston and is exposed to the hydraulic pressure in said upper neck bore portion.

6. A fastener installation tool according to claim 5 wherein:

the spring biases the secondary piston upwardly to a normal position in which the upper face of the secondary piston is proximate the upper end of the neck piston.

7. A fastener installation tool comprising:

a handle assembly including a base housing defining an air chamber, a head housing defining a head bore, and a neck housing interconnecting the base housing and the neck housing and encompassing a neck bore;

a hydraulic piston mounted in the neck bore;

an air piston mounted in the air chamber;

a piston rod interconnecting the air piston and the hydraulic piston;

a head piston mounted in the head bore;

first passage means extending from a location in said neck bore above said hydraulic piston to a location in said head bore rearwardly of said head piston;

second passage means extending from a location in said neck bore below said hydraulic piston to a location in said head bore forwardly of said head piston and coacting with said first passage means and said cylinder and head bores to define a closed loop hydraulic circuit;

hydraulic fluid filling said hydraulic circuit;

a secondary piston mounted in a blind bore opening at the upper end of said hydraulic piston; and spring means in said blind bore beneath said secondary piston normally operative to maintain the upper face of said secondary piston at a location proximate the upper end of said hydraulic piston but operative to yield in response to hydraulic pressure in said neck bore above said hydraulic piston above a predetermined upper limit to allow downward movement of said secondary piston in said blind bore to reduce the volume of said hydraulic piston and thereby reduce the hydraulic pressure above said hydraulic piston.

8. A fastener selection tool according to claim 7 wherein:

said tool further includes a cylinder positioned in upstanding fashion in said neck housing and defining said neck bore.

* * * * *

UNITED STATES PATENT AND TRADEMARK OFFICE

CERTIFICATE OF CORRECTION

PATENT NO. : 5,485,727
DATED : January 23, 1996
INVENTOR(S) : Bruce T. Godfrey

It is certified that error appears in the above-indentified patent and that said Letters Patent is hereby corrected as shown below:

Column 5, Line 3, after "the" and before "sense", insert -- effect, via passage 16g, of actuating spool valve 28 in a --.

Signed and Sealed this

First Day of October, 1996

Bruce Lehman

*Attest:*

BRUCE LEHMAN

*Attesting Officer*

*Commissioner of Patents and Trademarks*